United States Patent [19]

Schmidt

[11] 3,938,352

[45] Feb. 17, 1976

[54] WATER TO AIR HEAT PUMP EMPLOYING AN ENERGY AND CONDENSATE CONSERVATION SYSTEM

[75] Inventor: A. Carl Schmidt, Fort Lauderdale, Fla.

[73] Assignee: Weil-McLain Company, Inc., Dallas, Tex.

[22] Filed: July 10, 1974

[21] Appl. No.: 487,251

[52] U.S. Cl. ..... 62/279; 62/305; 62/428; 62/506; 62/324

[51] Int. Cl.[2] ..... F25D 47/00

[58] Field of Search ..... 62/183, 305, 428, 506, 62/324, 279

[56] References Cited

UNITED STATES PATENTS

| | | | |
|---|---|---|---|
| 2,181,213 | 11/1939 | Smith | 62/279 |
| 2,297,928 | 10/1942 | Wilson | 62/305 |
| 2,355,289 | 8/1944 | Gibson | 62/279 |
| 2,672,024 | 3/1954 | McGrath | 62/305 |
| 2,689,467 | 9/1954 | Verber | 62/279 |
| 2,751,761 | 6/1956 | Borgerd | 62/324 |
| 2,984,993 | 5/1961 | Carraway | 62/183 |
| 3,307,368 | 3/1967 | Harnish | 62/324 |
| 3,691,786 | 9/1972 | Anderson et al. | 62/279 |
| 3,812,687 | 5/1974 | Stolz | 62/279 |

*Primary Examiner*—William J. Wye
*Attorney, Agent, or Firm*—Lane, Aitken, Dunner & Ziems

[57] ABSTRACT

A water to air heat pump employing an energy and condensate conservation system in which a heat exchange fluid is circulated between two heat exchangers with one normally operating as a condenser and the other normally operating as an evaporator. The condensate from the air passing over the evaporator coil is collected and is passed to the condenser for circulating over the condenser coil. The heat pump is adapted to operate in a reverse mode in which the functions of the heat exchangers are reversed and in which the circulation of the collected condensate to the condenser is terminated.

14 Claims, 1 Drawing Figure

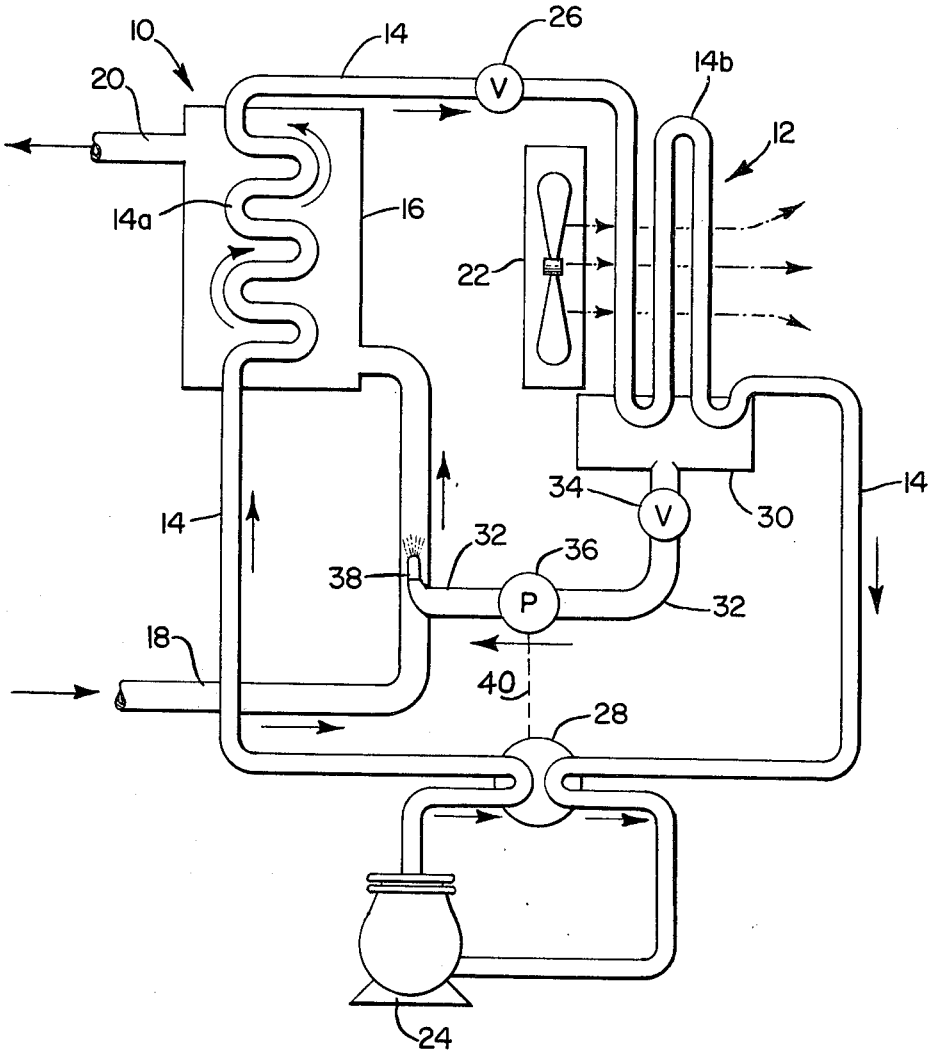
10
20
14
26
V
14b
12
14a
16
22
14
34
V
30
14
32
36
38
P
32
18
40
28
24

WATER TO AIR HEAT PUMP EMPLOYING AN ENERGY AND CONDENSATE CONSERVATION SYSTEM

BACKGROUND OF THE INVENTION

This invention relates to a water to air heat pump and, more particularly, to such a heat pump in which the condensate removed from the air at the evaporator portion of the system is collected and passed to the condenser portion of the system, to conserve the condensate.

In conventional air conditioning systems and heat pumps, a heat exchange fluid, such as freon or the like, is usually circulated through a coil or coils of an evaporator in a heat exchange relation with air which is blown across the coil and into an area to be cooled. Since the air passing over the evaporator coil often has its temperature reduced below its dew point, water or condensate collects on the coil and its associated fins and must be disposed of in some manner.

A large number of conventional air conditioning systems and heat pumps of this type have utilized a separate piping network which is connected to a drip pan, or the like, associated with each evaporator to pass the condensate collected from the evaporator to a common drain. However, it can be appreciated that this piping network adds to the cost of the system especially in the use of large installations. For example, in high rise apartment or office buildings when three hundred or more individual units are often utilized, the addition of an equal number of piping networks, some of which extend for substantially the entire height of the building for the sole purpose of disposing of the condensate, materially adds to the cost of the system from both a materials and labor standpoint.

SUMMARY OF THE INVENTION

It is, therefore, an object of the present invention to provide a water to air heat pump of the above type in which the condensate collected at the evaporator is disposed of in an efficient, low-cost manner.

It is a further object of the present invention to provide a water to air heat pump of the above type which substantially eliminates the piping network normally associated with the evaporator portion of the heat pump for disposing of the condensate.

It is a more specific object of the present invention to provide a water to air heat pump of the above type in which the condensate from the evaporator is directly routed to the condenser.

It is a further object of the present invention to provide a water to air heat pump of the above type in which the condenser of the heat pump utilizes liquid as a heat exchange medium and is therefore adapted to receive the condensate from the evaporator.

It is a still further object of the present invention to provide a water to air heat pump of the above type which is adaptable for use in a reverse mode in which the conditioned air is heated and in which the passage of the condensate from the evaporator to the condenser is terminated.

Toward the fulfillment of these and other objects, the heat pump of the present invention comprises a first and second heat exchanger, means for circulating a heat exchange fluid between said heat exchangers, said first heat exchanger including means for passing air in a heat exchange relation to said fluid, said second heat exchanger including means for circulating a liquid in a heat exchange relation to said fluid, said first heat exchanger adapted to act as an evaporator and evaporate said fluid and cool said air and said second heat exchanger adapted to act as a condenser and condense said fluid, means for collecting the condensate from said air at said first heat exchanger, and means for passing said condensate to said liquid circulating means.

BRIEF DESCRIPTION OF THE DRAWING

The drawing is a schematic representation of the water to air heat pump of the present invention.

DESCRIPTION OF THE PREFERRED EMBODIMENT

Referring specifically to the drawing, the reference numeral 10 refers in general to a heat exchanger which normally functions as a condenser, and the reference numeral 12 refers to an additional heat exchanger which normally functions as an evaporator. A flow line 14 provides a continuous flow path for a heat exchange fluid, such as freon, in a circuit including the heat exchangers 10 and 12.

The heat exchanger 10 includes a water jacket 16 surrounding a coiled portion 14a of the flow line 14. An inlet line 18 supplies a relatively cool liquid, such as water, from an external source to the jacket, and an outlet line 20 returns the water from the jacket back to the source. An example of such a water source would be a cooling tower, or the like, which cools the water received from the outlet line 20 before circulating it back into the inlet line 18, in a conventional manner.

The heat exchanger 12 includes a fan 22 which operates to discharge air across an additional coiled portion **14*b* of the line 14 and into the particular area to be cooled, such as a room of a building or the like. It is understood that both heat exchangers 10 and 12** can be provided with fins, and/or other hardware to promote the heat exchange between their respecitve fluids, in a conventional manner.

A compressor 24 and an expansion valve 26 are disposed in the line 14 and function to compress and expand the heat exchange fluid, respectively, also in a conventional manner.

A flow direction control valve 28 is disposed in the line 14 between the heat exchanger 12 and the compressor 24, and operates to control the direction of the flow of the heat exchange fluid in the line 14. In particular, in the normal, or air-cooling, mode of the system, the position of the valve 28 is such that flow of the heat exchange fluid in the line 14 is in the direction shown by the solid flow arrows in the drawing. The valve 28 can also operate to reverse the flow of fluid in the line 14 so that it flows in a direction opposite to that shown by the flow arrows, in which case the air from the fan 22 is heated as it passes over the coiled portion **14*b*, as will be described in detail later. Since the valve 28** is of a conventional design, it will not be described in any further detail.

A pan 30, or other type container, is disposed at the heat exchanger 12 immediately below the coiled portion **14*b*. In this manner, the condensate from the air passing over the coiled portion 14*b* and formed when the air has its temperature reduced below its dew point, collects on the coiled portion and its associated fins, and drips into the pan 30** by gravity.

A line 32 connects the pan 30 to the inlet line 18 for the water jacket 16, and a check valve 34 is disposed in the line 32 to insure one-way passage of the condensate from the pan 30 to the line 18 by preventing the possibility of a positive back pressure forcing the water in an opposite direction. A pump 36 is disposed in the line 32 for ejecting the condensate into the line 18 and may be of any conventional design such as a positive displacement diaphragm type. An aspirator 38 is disposed at the end of the line 32 and within the line 18 for aspirating the condensate injected into the line 18.

In operation and assuming it is desired to operate the heat pump in an air-cooling mode, the flow direction control valve 28 is positioned to cause the heat exchange fluid to flow in the line 14 in a direction indicated by the flow arrows, and the pump 36 is activated. In this mode, the heat exchanger 12 operates as an evaporator to cool the air passing over the coiled portion 14*b* and into the area to be cooled, while the heat exchanger 10 operates as a condenser. Water from an external source, such as a cooling tower, or the like, is passed into and through the inlet line 18 whereby it circulates through the water jacket 16 of the condenser 10 before exiting through the line 20. As a result, the water passes in a heat exchange relation to the fluid passing through the coiled portion 14*a* and removes the heat from the latter fluid while condensing it. The condensed heat exchange medium in the line 14 is then passed through the expansion valve 26 and through the coiled portion 14*b* associated with the heat exchanger 12, where it removes heat from the air passing over the latter coiled portion and into the area to be cooled. Under normal conditions this reduces the temperature of the air below its dew point and thus causes condensate to form on the coiled portion 14*b* and drip into the pan 30. The condensate collected in the pan 30 is pumped through the line 32 and into the inlet line 18 via the aspirator 38 under the force of the pump 36. The cold condensate from the pan 30 thus mixes with the water passing through the line 18 and into the jacket 16 and thus aids in cooling the heat exchange fluid passing through the coiled portion 14*a*.

In the event it is desired that the heat pump of the present invention operate in a reverse, or air-heating mode, the valve 28 is positioned to reverse the flow of the heat exchange fluid and cause it to flow in the line 14 in a direction opposite to that shown by the arrows in the drawing. In this instance, the pump 36 would be deactivated and the heat exchanger 10 would operate as an evaporator to transfer heat energy from the water passing through the jacket 16 to the heat exchange fluid which, in turn, transfers the heat energy to the air passing through the heat exchanger 12, which operates as a condenser. As a result, the area receiving the conditioned air from the fan 22 is heated.

As schematically shown by the dashed line 40 in the drawing, the pump 36 and the valve 28 may be operatively connected so that movement of the valve 28 to its normal, or air-cooling, mode activates the pump 36 while movement of the valve to its reverse, or air-heating, mode deactivates the pump. As an example of this type of arrangement, both the pump 36 and the valve 28 may be electrically operated and connected in the same electrical circuit. It is also understood that movement of the water through the lines 18 and 20 and the water jacket 16 can either be by gravity or by a small circulating pump or the like (not shown) associated with the heat exchanger 10.

Several advantages arise from the heat pump of the present invention. For example, the transfer of the relatively cool condensate from the pan 30 at the heat exchanger 12 to the heat exchanger 10 materially increases the efficiency of the system in its air-cooling mode since more cooling water is available to remove the heat from the heat exchange medium passing through the heat exchanger 10. Also, the condensate from the heat exchanger 12 can serve to replace the water lost in operation due to evaporation, or the like, especially when the source of the water supplied to the heat exchanger 10 is from a cooling tower or the like.

Further, the use of drain lines extending from the evaporator to a central drain source is eliminated according to the present invention, which is especially advantageous from both a cost and labor standpoint in the use of multi-unit systems.

It is also understood that variations may be made in the foregoing without departing from the scope of the invention. For example, in some installations, such as those utilizing a single system, the pump 36 may be eliminated to further reduce the cost of the system.

Of course, other variations of the specific construction and arrangement of the heat pump disclosed above can be made by those skilled in the art without departing from the invention as defined in the appended claims.

I claim:

1. A water to air heat pump comprising a first heat exchanger including a coil and means for passing air over said coil; a second heat exchanger including a coil and a jacket enclosing said coil, said jacket having an inlet for receiving water from an external source and an outlet for discharging said water back to said source, said water being continuously circulated through said jacket and over said coil; conduit means for circulating a heat exchange fluid between said coils, said first heat exchanger adapted to act as an evaporator and evaporate said fluid and cool said air, and said second heat exchanger adapted to act as a condenser and condense said fluid; means for collecting the condensate from said air at said first heat exchanger; and means for passing said condensate to said jacket for mixing with said water and circulating over the coil associated with said second heat exchanger.

2. The heat pump of claim 1 further comprising valve means associated with said passing means for preventing the flow of condensate from said jacket to said condensate collecting means.

3. The heat pump of claim 1 further comprising a pump for pumping said condensate from said condensate collecting means to said jacket.

4. The heat pump of claim 3 wherein said conduit means normally passes said fluid from the outlet of said first heat exchanger to the inlet of said second heat exchanger and further comprising reversing valve means disposed in said conduit means for reversing the flow of said fluid so that said first heat exchanger acts as a condenser and said second heat exchanger acts as an evaporator.

5. The heat pump of claim 4 wherein said pump is deactivated in response to said reversing of the flow of said fluid.

6. The heat pump of claim 1 wherein said conduit means normally passes said fluid from the outlet of said first heat exchanger to the inlet of said second heat exchanger and further comprising reversing valve means disposed in said conduit means for reversing the flow of said fluid so that said first heat exchanger acts as a condenser and said second heat exchanger acts as an evaporator.

7. The heat pump of claim 1 further comprising a compressor associated with said conduit means.

8. The heat pump of claim 1 further comprising an expansion valve disposed in said conduit means. exchanger

9. A water to air heat pump comprising a first heat exchanger including a coil and means for passing air over said coil; a second heat exchanger including a coil and a jacket enclosing said coil for circulating water over said coil; conduit means for circulating a heat echanger fluid between said coils, said first heat exchanger adapted to act as an evaporator and evaporate said fluid and cool said air, and said second heat exchanger adapted to act as a condenser and condense said fluid; means for collecting the condensate from said air at said first heat exchanger; means for passing said condensate to said jacket for mixing with said water and circulating over the coil associated with said second heat exchanger; and valve means associated with said passing means for preventing the flow of condensate from said jacket to said condensate collecting means.

10. The heat pump of claim 9 further comprising a pump for pumping said condensate from said condensate collecting means to said jacket.

11. The heat pump of claim 10 wherein said conduit means normally passes said fluid from the outlet of said first heat exchanger to the inlet of said second heat exchanger and further comprising reversing valve means disposed in said conduit means for reversing the flow of said fluid so that said first heat exchanger acts as a condenser and said second heat exchanger acts as an evaporator.

12. The heat pump of claim 11 wherein said pump is deactivated in response to said reversing of the flow of said fluid.

13. The heat pump of claim 9 wherein said conduit means normally passes said fluid from the outlet of said first heat exchanger to the inlet of said second heat exchanger and further comprising reversing valve means disposed in said conduit means for reversing the flow of said fluid so that said first heat exchanger acts as a condenser and said second heat exchanger acts as an evaporator.

14. A water to air heat pump comprising an evaporator including a coil and means for passing air over said coil, a condenser including a coil and a jacket enclosing said coil for circulating water over said coil, a compressor, conduit means for passing a heat exchange fluid from said condenser to said evaporator where said fluid is evaporated and said air is cooled, conduit means for passing the evaporated fluid from said evaporator to said compressor for compressing the fluid, conduit means for passing said compressed fluid from said compressor directly to said condenser where it is condensed by said water, means for collecting the condensate from air at said evaporator, and means for passing said latter condensate to said jacket for mixing with said water and circulating over the coil associated with said condenser.

* * * * *

UNITED STATES PATENT OFFICE
CERTIFICATE OF CORRECTION

Patent No. 3,938,352 Dated February 17, 1976

Inventor(s) A. Carl Schmidt

It is certified that error appears in the above-identified patent and that said Letters Patent are hereby corrected as shown below:

In the Claims

Claim 8, line 2, after "means." delete "exchanger"

Signed and Sealed this

*eleventh* Day of *May 1976*

[SEAL]

*Attest:*

RUTH C. MASON
*Attesting Officer*

C. MARSHALL DANN
*Commissioner of Patents and Trademarks*